US008085969B2

(12) United States Patent
Simidian, II et al.

(10) Patent No.: US 8,085,969 B2
(45) Date of Patent: Dec. 27, 2011

(54) FULL RANGE PLANAR MAGNETIC MICROPHONE AND ARRAYS THEREOF

(75) Inventors: Vahan Simidian, II, Newport Beach, CA (US); Dragoslav Colich, Costa Mesa, CA (US)

(73) Assignee: HPV Technologies, Inc., Irvine, CA (US)

( * ) Notice: Subject to any disclaimer, the term of this patent is extended or adjusted under 35 U.S.C. 154(b) by 1136 days.

(21) Appl. No.: 11/855,405

(22) Filed: Sep. 14, 2007

(65) Prior Publication Data

US 2008/0219469 A1 Sep. 11, 2008

Related U.S. Application Data

(60) Provisional application No. 60/845,049, filed on Sep. 15, 2006, provisional application No. 60/845,050, filed on Sep. 15, 2006.

(51) Int. Cl.
*H04R 11/02* (2006.01)

(52) U.S. Cl. ..... 381/399; 381/398; 381/412; 367/131

(58) Field of Classification Search ..... 381/398, 381/399, 431, 412, 421, 111, 423, 92, 98, 381/59, 122; 367/131
See application file for complete search history.

(56) References Cited

U.S. PATENT DOCUMENTS

| | | | | |
|---|---|---|---|---|
| 5,850,461 | A * | 12/1998 | Zelinka | 381/398 |
| 5,901,235 | A * | 5/1999 | Thigpen et al. | 381/431 |
| 6,972,715 | B2 | 12/2005 | Hollis et al. | |
| 7,203,332 | B2 * | 4/2007 | Hutt et al. | 381/399 |
| 7,251,342 | B2 * | 7/2007 | Graebener | 381/431 |
| 2002/0191808 | A1 * | 12/2002 | Croft et al. | 381/431 |
| 2005/0036648 | A1 | 2/2005 | Nguyen et al. | |
| 2007/0159925 | A1 * | 7/2007 | Chryssostomidis et al. | 367/134 |

* cited by examiner

*Primary Examiner* — Vivian Chin
*Assistant Examiner* — Friedrich W Fahnert
(74) *Attorney, Agent, or Firm* — Fish & Associates, PC

(57) ABSTRACT

Contemplated planar magnetic microphones have a magnet and diaphragm arrangement such that substantially homogenous vertical and high horizontal magnetic flux density is realized in the inter-magnet space. Most preferably, the diaphragm is disposed in the inter-magnet space and includes a voice coil covering a significant fraction of the active portion of the membrane. In further especially preferred aspects, the membrane is sufficiently strong and tensioned to allow a large elastic excursion in the inter-magnet space. Consequently, contemplated planar magnetic microphones provide exceptionally large dynamic range without compression and/or distortion and can be easily configured to operate in an environment that is subject to moisture, rain, or to even operate in a submerged environment. Moreover, contemplated microphones can be used as speakers at even high SPL without reconfiguration.

25 Claims, 5 Drawing Sheets

Magnetic Flux Density along the vertical magnetic gap between two opposing magnets

Bx- Magnetic Flux Density between two rows of magnets in the plane of the diaphragm

FULL RANGE PLANAR MAGNETIC MICROPHONE AND ARRAYS THEREOF

This application claims priority to our U.S. provisional applications with the Ser. Nos. 60/845,049, filed Sep. 15, 2006, and 60/845,050, filed Sep. 15, 2006, both of which are incorporated by reference herein.

FIELD OF THE INVENTION

The field of the invention is microphones and arrays thereof, and especially microphones with a planar magnetic transducer.

BACKGROUND OF THE INVENTION

Microphones are ubiquitous devices that convert acoustic signals to electric signals and can be found in many devices, including telephones, tape recorders, hearing aids, etc., wherein the choice of transducer is often determined by the particular sound or environment in which the transducer is employed.

For example, condenser or capacitor microphones employ a diaphragm that acts as one plate of a capacitor, in which vibrations caused by impinging sound produce changes in the distance between the capacitor plates. A similar principle is used in electret condenser microphones in which a permanently electrically charged or polarized dielectric material is part of the capacitor circuit. In other examples, a dynamic microphone uses a small and movable coil that is positioned in the magnetic field of a permanent magnet, wherein the coil is attached to the diaphragm. Similarly, a ribbon microphone employs a thin, usually corrugated metal ribbon that is suspended in a magnetic field, wherein the ribbon is electrically connected to the microphone output. Vibration of the ribbon within the magnetic field generates the electrical signal. In yet another class of microphones, piezoelectric materials are employed in which the sound pressure impinging onto the material produces a voltage across the material.

However, almost all of the known microphones are designed to operate in a particular SPL (sound pressure level) range and will therefore either be sensitive to low SPL and distort at high SPL or tolerate high SPL at the expense of sensitivity to low SPL sounds. Still further, at SPL of above 90 db, compression is typically required, or distortion will significantly increase. Further disadvantages are encountered in most microphones with respect to directionality. Most typically, directionality is achieved by housing design such that at least some of the off-axis sound waves are canceled or reduced. Unfortunately, and especially where high directionality is desirable, the design of such microphones often limits the range of uses.

Therefore, while numerous microphones are known in the art, all or almost all of them suffer from one or more disadvantages. Consequently, there is still a need to provide improved configurations and methods for improved microphones, especially where large dynamic range and/or directionality are desired.

SUMMARY OF THE INVENTION

The present invention is directed to configurations and methods in which a preferably full-range planar magnetic transducer is employed as a microphone that has an extremely large dynamic range in a frequency spectrum of at least between 100 Hz and 20 kHz. Most preferably, the microphone is also configured to allow underwater use, and in further preferred aspects, two or more transducers are arranged to an array to provide increased directivity and sensitivity of the microphone.

In one aspect of the inventive subject matter, a method of recording sound comprises a step of providing a planar magnetic transducer having a plurality of magnets and a tensioned diaphragm disposed between at least two of the magnets, wherein the diaphragm comprises a voice coil and wherein the magnets are arranged relative to each other such that a distance between the at least two of the magnets is at least 1 mm, more preferably at least 2 mm, even more preferably at least 4 mm, and most preferably at least 5 mm, an average magnetic flux density between the at least two magnets in a plane perpendicular to the diaphragm is at least 0.35 T and substantially homogenous, and an average magnetic flux density between a third magnet and one of the at least two magnets in a plane of the diaphragm is at least 0.3 T. In another step, an electrical signal from the voice coil is fed to an amplifier.

Most preferably, the diaphragm is sufficiently tensioned to allow recording of sound having a frequency of between 100 Hz and 20 kHz at a sound pressure level in a range of between 10 db and 100 db, more typically between 10 db and 120 db, and most typically between 10 db and 140 db (and even higher) without compression and distortion. Based on these parameters, it should be noted that the planar magnetic microphone output is unexpectedly high, and typical configurations can be operated without preamplifier. Depending on the SPL, output voltages from contemplated microphones may be as high as several volts, which is in more than 10,000-fold excess of heretofore known typical devices. Moreover, contemplated microphones operate over a full-range frequency range, typically between 100 Hz and 20 kHz.

In further preferred aspects, the voice coil, and more typically the entire diaphragm is coated with an electrically insulating layer to allow recording under water. In such embodiments, it is generally preferred that the transducer has an upper portion and a lower portion, wherein the diaphragm is disposed between the upper portion and the lower portion, and wherein the upper and lower portions have a plurality of openings that are in fluid communication with water outside the transducer.

Where desired, it is contemplated that a second planar magnetic transducer is provided and coupled to the planar magnetic transducer to thereby form an array of transducers. Such arrays may advantageously include between two and thirty individual transducers, which are most preferably configured to allow for directional acquisition of sound. For example, suitable arrays may have a substantially flat n1×n2 arrangement with an active transducer membrane area of between 150 $cm^2$ and 1000 $cm^2$, wherein n1 and n2 are independently integers between 2 and 12, inclusive, and wherein n1/n2 is between 0.4 and 2.5, inclusive. Additionally, methods contemplated herein may further include a step of feeding a second electrical signal to the transducer to thereby operate the transducer as a speaker when the transducer is not operated as a microphone. Such electrical signal may then cause the transducer to produce sound having a frequency of between 100 Hz and 20 kHz at a sound pressure level in a range of between 10 db and 100 db, more typically between 10 db and 120 db, and most typically between 10 db and 140 db.

In another aspect of the inventive subject matter, an observation system may include a plurality of arrays of optionally submersible planar magnetic transducers, wherein each of the arrays is configured to allow for directional acquisition of sound. A processing unit is further provided that is electronically coupled to at least two of the arrays and that is configured to determine at least one informational parameter of a sound emitting object. Among other suitable informational parameters, it is preferred that the parameter is selected from the group consisting of location of the sound emitting object, type of the sound emitting object, speed of the sound emitting object, and communication signal of the sound emitting object. Most preferably, the arrays are configured to allow submersible use, and/or the processing unit is configured to perform at least one operation selected from the group consisting of triangulation, echolocation, and seismography. Additionally, contemplated systems may also include an amplifier that is electronically coupled to the plurality of arrays and that is configured to feed an electrical signal to at least one of the arrays to thereby operate the at least one of the arrays as a speaker.

In a still further aspect of the inventive subject matter, a communication system may have (1) a full-range planar magnetic transducer electronically coupled to a first amplifier that is configured to amplify a first electrical signal from a voice coil of the transducer, and (2) a second amplifier electronically coupled to the full-range planar magnetic transducer and configured to provide a second electrical signal to the voice coil of the transducer, wherein the first amplifier is further configured to generate an audio output signal from the first electrical signal, and wherein the second amplifier is configured to drive the transducer to produce sound having a frequency of between at least 100 Hz and 20 kHz at a sound pressure level in a range of between 10 db and at least 100 db. Where desired, multiple full-range planar magnetic transducers in contemplated communication systems may be configured as an array.

Various objects, features, aspects and advantages of the present invention will become more apparent from the following detailed description of preferred embodiments of the invention.

DETAILED DESCRIPTION

Figure 1A:
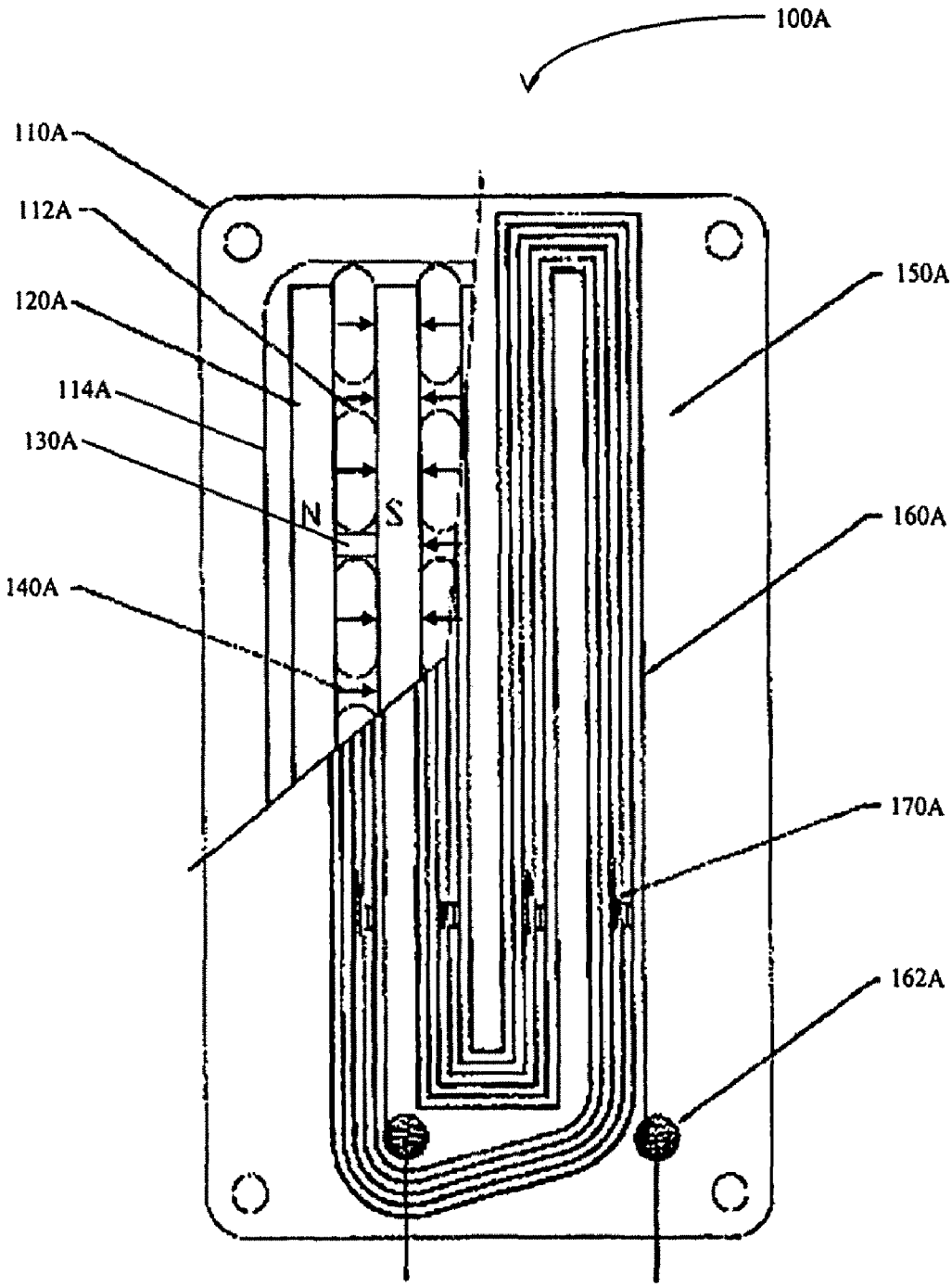
FIG. 1A is a schematic of an exemplary planar magnetic transducer according to the inventive subject matter.

The inventors have surprisingly discovered that planar magnetic speakers can be operated as a microphone with numerous unexpected and highly desirable properties. While conventional speaker transducers can be operated in a reverse manner to thereby function as a microphone, it is generally recognized that such reversal will typically result in unacceptable sound quality, low sensitivity, and consequently often low signal-to-noise ratio. In contrast, and especially where contemplated planar magnetic speakers are employed as a microphone, the inventors now have discovered that such microphones will provide superior sensitivity, sound quality, and dynamic range. Indeed, using the planar magnetic microphone according to the inventive subject matter, sounds with SPL between 10 db (and even less) and 150 db (and even more) can be accurately recorded without distortion or loss in sound quality over a frequency range of at least 100 Hz to 20 kHz.

Such difference is readily apparent when one compares an average 0.5 inch microphone (diaphragm diameter of dynamic microphone) to an exemplary planar magnetic transducer as presented herein. The surface area of the diaphragm of the 0.5 inch microphone calculates to about 1.2 $cm^2$ while the surface area of the diaphragm of typical contemplated transducers is approximately 170 $cm^2$, which is 142-fold increase in diaphragm area. Assuming that one would obtain the same voltage output per $cm^2$ for a specific SPL, contemplated transducers can produce 142 times higher voltage output (equating to a 43 dB higher level). Thus, it should be recognized that contemplated planar magnetic transducers require substantially less electrical amplification. Indeed, most of the planar magnetic transducers presented herein can be operated without a pre-amplifier. In this context, it should be appreciated that high amplifier gain required to amplify an ordinary microphone signal will cause electrical noise, which in turn limits the recordability of sounds at the lower end of the SPL spectrum. Consequently, as the planar magnetic transducers contemplated herein provide 43 db higher electrical output, 43 dB softer sounds can be recorded (as compared to conventional microphones) and listening distance is dramatically increased. Such advantages will become even more apparent when the planar magnetic transducers are coupled together in an array, which effectively further increases the diaphragm area. For example, a 2×3 array of contemplated transducers were operated as a microphone that was able to pick up normal voice levels in unparalleled clarity at a distance of about 450 feet in a high ambient noise level (city traffic and industry noise) environment.

An exemplary planar magnetic transducer 100A is schematically illustrated in FIG. 1A in which a portion of the diaphragm is removed to expose underlying bar magnets, spacer elements, and other components. Here the stator frame 110A has a plurality of perforations 112A through which sound enters and heat is dissipated. Bar magnets 120A are coupled to the stator in a parallel fashion with alternating polarity (as indicated by North [N] and South [S]). Proper mounting alignment and distance of the magnets is maintained by spacer elements 130A (only one spacer shown), which also reduce tension on the coupling material that holds the magnets to the stator. Such spacers are particularly advantageous where the magnets are very strong, as at the relatively small gap between adjacent magnets leads to significant attraction between the magnets. Arrows 140A indicate the direction of the magnetic field between the adjacent magnets. The diaphragm is 150A is mounted to the stator 110A and further includes conductive trace 160A, which runs above the gap between adjacent magnets and has a layout such that current flows unidirectional with respect to the magnetic field between adjacent magnets as indicated by arrows 170A. Both ends of the conductive trace terminate in electric terminals 162A. The active (i.e., moving) area of the diaphragm is located within the space defined by wall 114A that forms part of the cavity (see also below).

Figure 1B:
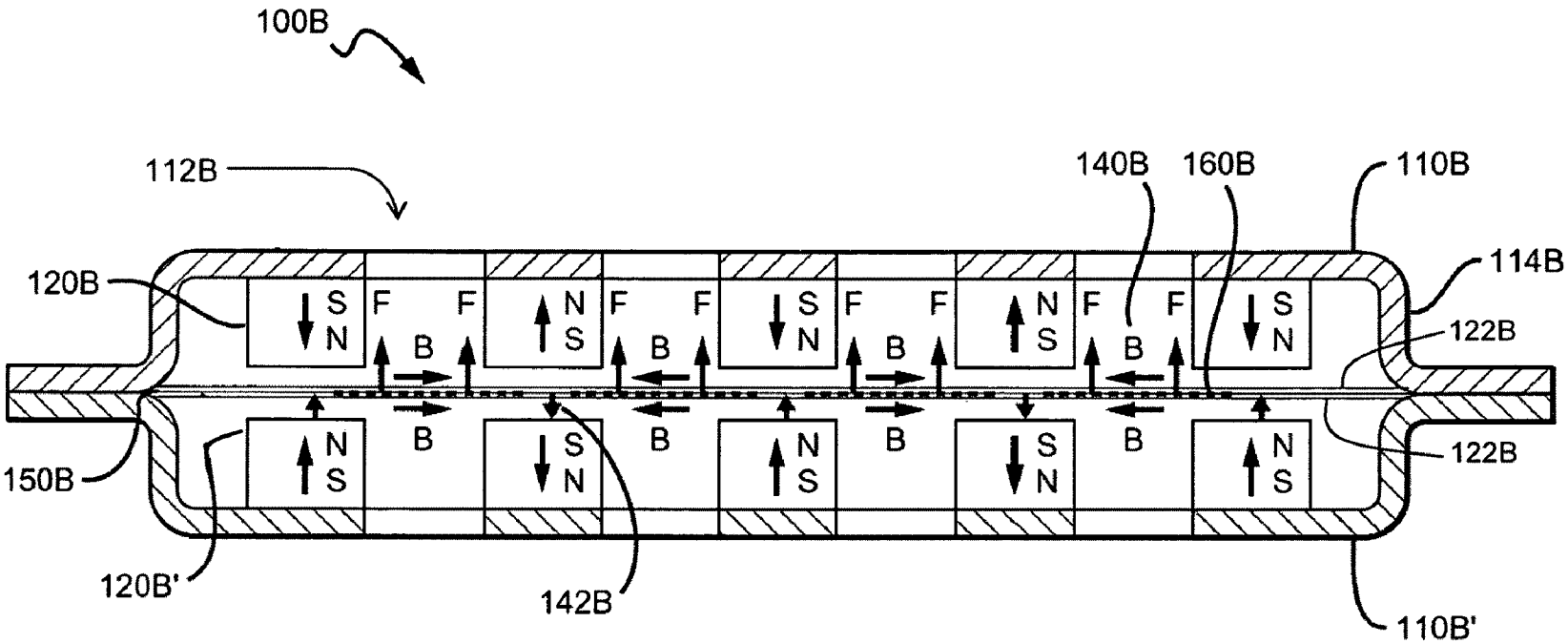
FIG. 1B is a schematic of a cross section of an exemplary planar magnetic transducer according to the inventive subject matter.

FIG. 1B depicts a vertical cross section of an exemplary planar magnetic transducer 100B in which the housing has upper and lower stators 110B and 110B', respectively. Disposed between the stators is the diaphragm 150B, which is also centered between opposing magnets 120B and 120B' such that opposing magnets face each other with the same polarity (as indicated by North [N] and South [S]). The diaphragm 150B is optionally covered by top and bottom layer 122B that provide an electrically insulating layer to isolate the voice coil 160B. As above, the stators have a wall 114B to define a cavity to accommodate the magnets and the diaphragm, and perforations 112B to allow sound to enter and heat to escape. Horizontal magnetic flux is indicated by 140B while vertical magnetic flux is indicated by 142B. Current is induced in the conductive trace 160B by sound pressure F, which forces the diaphragm and voice coil 160 to move in the magnetic fields.

It is generally contemplated that the planar magnetic transducers presented herein will have magnets that provide a relatively high magnetic field strength in the x-axis (defined as the axis that is parallel to the plane of the diaphragm). Therefore, in especially preferred aspects, magnets will include neodymium or other rare earth metals alone or in combination with one or more rare earth metals, iron, and/or boron. In preferred aspects of the inventive subject matter, the magnets are bar magnets arranged in an array of parallel bars with opposing neighboring polarity. Most preferably, a second series of corresponding bar magnets is facing the first array with a same polarity to thereby form a push-pull system. However, numerous alternative arrangements are also deemed suitable and include curved or otherwise irregularly shaped bar magnets, ring magnets, etc., so long as a magnetic gap can be achieved with properties that allow large diaphragm excursion in a magnetic field of at least 0.3 T (in x-axis and y-axis).

Regardless of the specific arrangement of the magnets, it is especially preferred that the magnetic field strength in the x-axis between the magnets is at least 0.35 T, more preferably at least 0.4 T, even more preferably at least 0.45 T, and most preferably 0.5 T and higher. Still further, the inventors discovered that substantially increased performance is obtained in magnet arrangements where at least 70%, more preferably at least 80%, and most preferably at least 85% of the space between the magnets in the y-axis has a substantially homogenous magnetic field strength of at least 0.4 T, even more preferably at least 0.45 T, and most preferably 0.5 T and higher. Therefore, the average magnetic flux density between a third magnet and one of the at least two magnets in a plane of the diaphragm is at least 0.3 T (average magnetic flux density as used herein refers to the magnetic flux density that is present over at least 60% across the gap [either between opposing or adjacent magnets]).

Such conditions are typically achieved by placing and maintaining high-strength magnets on the respective stators in relatively close proximity. Under most circumstances, it should be noted that magnets of that strength will not be mountable in a manual process as the attractive forces between adjacent magnets are too severe for hand-held installation in an unassisted one-by-one manner. Therefore, it is typically preferred that the magnets are secured in position by spacer elements between the adjacent magnets. Coupling of the magnets to the stator may then be performed using (optional grooves and) various manners well known in the art. However, it is generally preferred that the magnets are secured to the stator using high-strength adhesives (e.g., acrylate-based adhesive). It should further be appreciated that the spacer elements (e.g., comprising glassy carbon, balsawood, fiberglass, etc.) will not only provide a fixed distance for adjacent magnets, but may also serve as anchors through which adjacent magnets are secured to each other (e.g., via high-strength adhesive, etc). Therefore, spacers also serve as a stabilizing element and will reduce stress on the bond between the stator and the individual magnets.

Figure 2A:
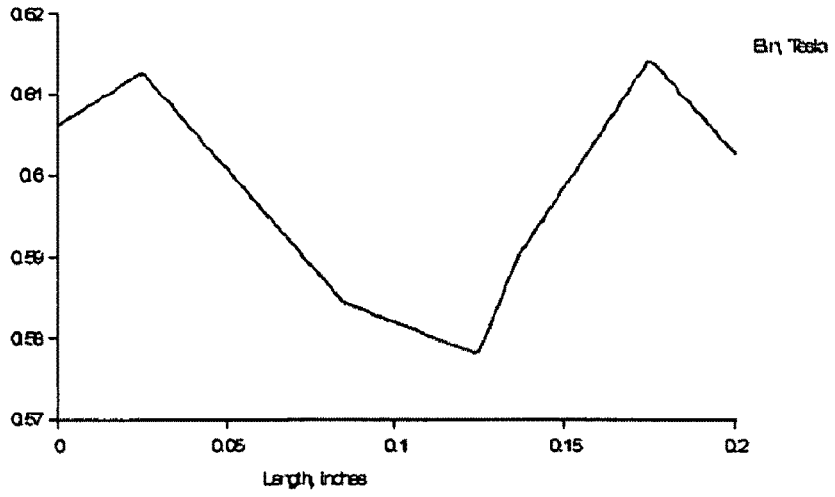
FIG. 2A is a graph illustrating magnetic flux density in the vertical gap between two bar magnets.
Figure 2B:
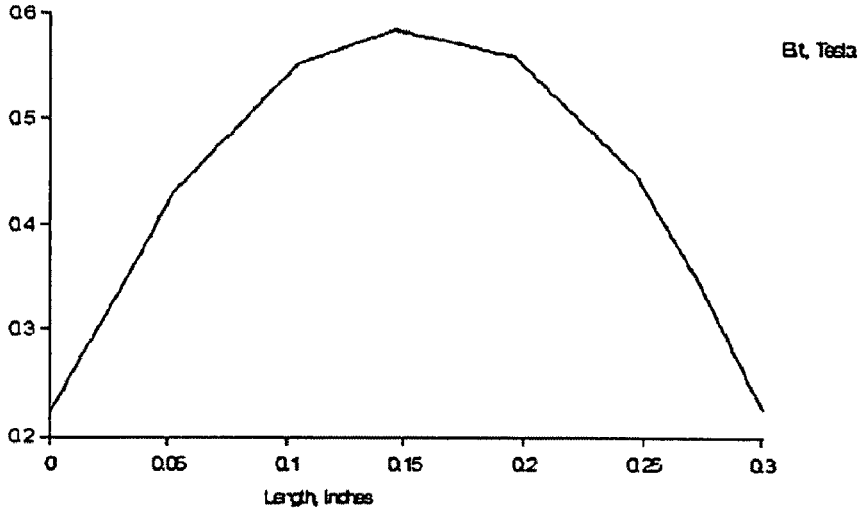
FIG. 2B is a graph illustrating magnetic flux density in the horizontal plane between two bar magnets in the plane of the diaphragm.

A typical result of measurement of the magnetic field strength in y-axis is shown in FIG. 2A (within vertical distance between magnet and diaphragm as indicated), while FIG. 2B depicts the measurement of the magnetic field strength in x-axis magnets at a vertical distance from the magnet equivalent to the diaphragm distance. As can be taken from the Figures, the magnetic field strength in y-axis is extremely homogenous and strong over a large range of the vertical gap between the magnets. In such arrangements, it is typically preferred to position the voice coil (or plurality of traces of the voice coil) such that the coil is exposed to a magnetic field strength in the x-axis of at least 0.3 T, more preferably at least 0.35 T, and most preferably at least 0.4 T. Depending on the particular configuration of the magnets, it should be recognized that the exact number of traces for the voice coil may vary considerably. Thus, single and multiple traces (typically parallel) are especially contemplated, wherein at least 50%, more typically at least 60%, and most typically at least 70% of the active (moving) diaphragm area will be covered by the voice coil (the term "voice coil" as used herein refers to the conductive trace on the diaphragm, and where multiple traces are adjacent to each other as shown in FIGS. 1A and 1B, the term voice coil also includes the space between conductive traces that are disposed at and over the gap between two adjacent magnets).

With respect to the gap, it is generally contemplated that the vertical gap between two opposing magnets (that will typically exhibit the same polarity) is determined to a relatively large degree by the strength of the magnetic materials used in the magnets and the desired current to the voice coil. However, in particularly preferred aspects, the gap between two opposing magnets will be at least 1 mm, more preferably at least 2-3 mm, and most preferably between 4-5 mm (and even more). Such gap width is especially preferred where the diaphragm is positioned in a vertical distance from the magnets that ensures an average magnetic field strength of at least 0.4 T, and more typically at least 0.5 T in direction of the x-axis. Thus, average magnetic flux density between the at least two magnets in a plane perpendicular to the diaphragm is at least 0.35 T and substantially homogenous (substantially homogenous refers to an absolute numerical deviation of less that 15%). As a consequence, and at least in part due to the relatively strong and homogenous magnetic field strength across a substantial portion (at least 70%, more typically at least 80%) of the vertical gap between the magnets, the diaphragm will have a substantially improved range of excursion and will produce over an extremely large range of sound pressure levels currents of up to several volts. Thus, and also due to further factors addressed below, dynamic range and efficiency is substantially increased, total harmonic distortion is substantially decreased, allowing for sensitivity, SPL level ranges, and clarity that were heretofore not achieved. Viewed from a different perspective, it should be appreciated that the entire area that is moved by sound pressure will directly and uniformly produce current.

It is contemplated that numerous types of magnets are suitable for use in conjunction with the inventive subject matter presented herein, and especially suitable magnets include neodymium magnets with a surface field of at least 2000 Gauss, more preferably at least 2500 Gauss, even more preferably at least 3000 Gauss, and most preferably at least 3500 Gauss. Viewed from another perspective, especially preferred magnets include neodymium magnets with iron and/or boron of varying grades (e.g., N35, N38, N42, N50, N54), which preferably have a temperature rating for operation up to temperatures of 100° C., more preferably 120° C., and most preferably 150° C. (and even higher). Alternatively, in less preferred aspects, suitable magnets also include samarium-cobalt magnets, and even less preferably electromagnets.

It should be noted that the magnetic field density is very linear between rows of magnets as well as along the depth of the magnetic gap. This helps create a linear relationship between the acoustic driving force and the induced current that is obtained from the moving diaphragm and voice coil with minimum distortion. Most preferably, the diaphragm is properly tensioned and stretched on a flat surface of the active stator. This, together with very strong uniform driving force evenly distributed across the surface of the diaphragm, provides excellent sound quality with extremely low distortion.

It should further be noted that the magnets are preferably arranged such that North and South poles alternate in neighboring magnets, and that the steel stators close the magnetic circuits. Thus, the stators serve more than one purpose: (a) to provide a mounting support for the magnets, (b) to close the magnetic circuits between the magnets, and (c) to provide a flat surface onto which the stretched diaphragm is bonded. On one of the stators (the active stator), the thin diaphragm with printed or etched conductive coil is stretched and bonded, and the conductive traces are centered between magnets in a predefined pattern. Traces are arranged on the diaphragm surface such that the current is induced in the same direction of the conductor. Viewed from another perspective, it should be noted that when the diaphragm changes direction, the induced current changes direction in the voice coil. Moreover, it should be noted that even though the diaphragm is flexible, it will provide pistonic movement of the diaphragm in the area where the voice coil is present. Most typically, the voice coil covers more than 60%, more typically more than 70, and most typically more than 80% of its active (moving) surface.

In a basic configuration, contemplated transducers typically operate as a dipole. Dipole microphones are sensitive to sound on both sides of the diaphragm with equal intensity, but opposite phase (front and rear sound waves meet on a side of the transducer and cancel, leading to a typical figure of eight). Thus, sound on the side, top and bottom is almost completely canceled and directionality for front and rear side are achieved. If a dipole transducer is mounted in a closed cabinet, monopole characteristics are achieved. Where desired, an open enclosure can be used and rear waves can be absorbed to obtain cardioid characteristics maintaining sound cancellation on the sides at greatly reduced rear sensitivity.

As the configurations above allow for substantial application of force to the diaphragm, the inventors recognized that proper diaphragm tension and installation is of significance to the performance of contemplated transducers, and that uniformity in stretching the diaphragm (i.e., membrane) is a significant contributor to the high performance. Thus, in particularly preferred aspects of the inventive subject matter, it is contemplated that at least 85%, more typically at least 90%, and most typically at least 95% (and even higher) of the active area of the diaphragm will have substantially the same tension (i.e., force required for a specific deflection at a specific location has no more than 10% absolute variation to the force required for the same deflection at another location). The proper tension will typically depend on the particular material employed, and it is contemplated that a person of ordinary skill will be apprised of suitable tension ranges for particular materials. In one example, various polyesters, and especially MYLAR™ (DuPont: Polyethylene terephthalate film) is employed as diaphragm material and includes voice coil traces photolithographically deposited thereon. Alternatively, and especially for very high SPL, the diaphragm material may also comprise a polyamide film, including KAPTON™ (DuPont: Condensation product of a diamine and pyromellitic acid). Suitable tension ranges are well known to the artisan for such materials, and all of these tensions (up to 50%, more preferably up 70%, even more preferably up 85%, and most preferably up 95% of the upper end of the elastic range of the material) are deemed suitable for use herein. Viewed from another perspective, the diaphragm of contemplated transducers will be tensioned such that a force of 1 $N/cm^2$ to about 30 $N/cm^2$, and more typically 3 $N/cm^2$ to about 20 $N/cm^2$, and most typically 5 $N/cm^2$ to about 15 $N/cm^2$ will result in the diaphragm to touch the magnet when the diaphragm is installed into the stator.

Furthermore, it should be appreciated that the forces for tensioning the diaphragm in x- and y-direction of the diaphragm may be identical or may be different. For example, in one embodiment, the diaphragm is tensioned with equal force, while in other diaphragms, the forces differ at least 10%, and more typically at least 25%. Regardless of the manner of tensioning, it should be appreciated that preferred manners of tensioning will allow quantifiable application of force to thereby ensure consistent batch-to-batch tensioning. While the diaphragm may be pre-tensioned in a carrier and be mounted to the frame in the carrier in the pre-tensioned state, it is generally preferred that the diaphragm is tensioned and that the frame (including the magnets and other components) is mounted to the tensioned diaphragm while under tension. There are numerous manners of mounting known in the art and suitable manners include attachment using setting resins, glues, and other chemical compounds. Alternatively, in less preferred aspects, clamps and/or tensioning ridges may also be suitable. In still further contemplated aspects, tensioning and mounting may also use commercially available services (e.g., tension/mounting protocol 14-1 of HPV Technologies). It should be especially appreciated that uniform diaphragm tensioning will significantly provide dampening at the resonance frequency, ensure homogenous frequency response and reduce distortion. Thus, uniformity of tensioning of at least 90-95% of the active diaphragm area is typically preferred. Alternatively, or additionally, dampening materials may be included and suitable materials include all materials that allow for air flow through the material. However, particularly preferred materials include non-woven cloth and felts (which also may provide physical protection from environmental agents/forces).

Conductive traces may be formed on the diaphragm in all manners known in the art and will preferably include photolithographic methods, melt-pressing of conductive material into the diaphragm, in-situ generation of conductive traces in the diaphragm material, etc. Moreover, while it is generally preferred that the voice coil is present on only one side of the diaphragm, traces may also be disposed on both sides of the diaphragm. Additionally, where desirable, the diaphragm with conductive traces may also be laminated between two further (and preferably thin) layers of material to provide electrical insulation where the diaphragm is exposed to conductive materials, and especially water. It should further be noted that multiple diaphragms are also deemed suitable. In such case, the diaphragms will carry a voice coil on at least one side and will typically include an interlacing layer of insulating material.

In especially preferred aspects, at least a portion of the diaphragm (and most typically the portion comprising the voice coil) is covered by a layer of electrically insulating material, which may be deposited onto the diaphragm in numerous manners well known to the art. Among other options, it is contemplated that the insulating layer may be spray-coated, laminated, or otherwise deposited in a single layer. Similarly, there are numerous suitable insulating materials available to cover the diaphragm and/or voice coil, and especially contemplated materials include various and optionally substituted polyethylenes, polypropylenes, polyethylene terephthalates, etc. Alternatively, the insulating layer may also be a thermoplastic material that is coated onto the diaphragm, or a material that polymerizes and/or gels upon deposition. Such transducers may advantageously be used under water regardless of the depth as a hydrophone. As contemplated transducers already exhibit exceptional directionality, it should be noted that due to the sound propagation in water, contemplated hydrophones will provide a highly sensitive and directional microphone. Among other uses, such microphones may be employed as listening devices for submarine activity (natural and otherwise), which may be employed, for example, as a buoy based microphone network or deployable listening device.

It should be noted that microphone sensitivity is generally dependent on the diaphragm surface as a specific sound pressure level generates the force that moves diaphragm. Higher forces will move the diaphragm further and thus generate a higher voltage. As the transducers contemplated herein provide a large range for diaphragm excursion within a strong magnetic field, and as the diaphragm is a strongly tensioned membrane, contemplated planar magnetic transducers can be used as a very sensitive, directional, very low distortion microphone for extremely high SPL, typically without any need for compression or other signal manipulation. Still further (and among other factors), as substantial forces are required to force the diaphragm against the stator or dampening material, extremely loud sounds (e.g., >160 dB, close proximity recording of jet engines, rocket engines, explosions, etc.) can be recorded without distortion.

Figure 3:
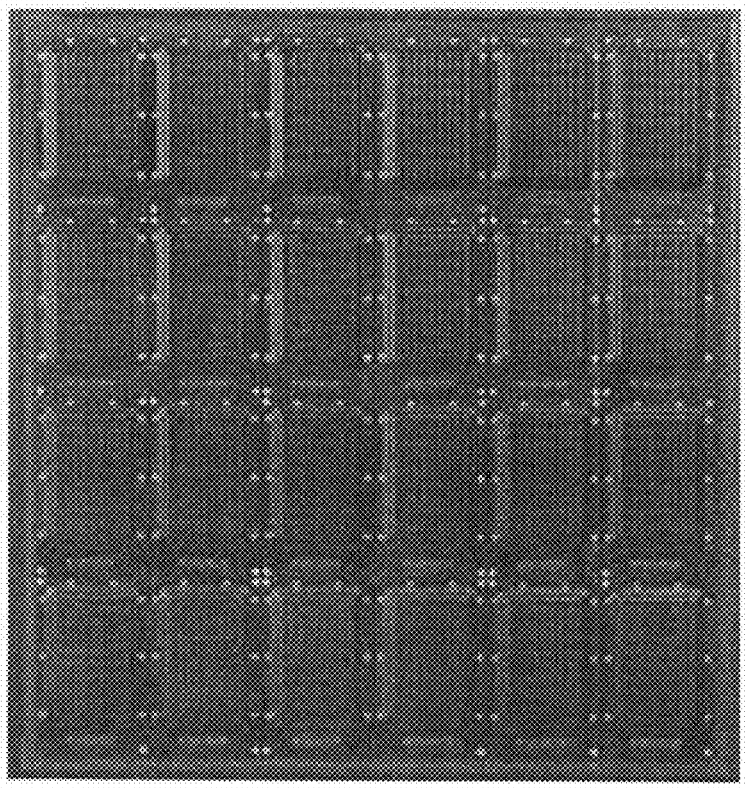
FIG. 3 is a photograph of a 6×4 array of planar magnetic microphones according to the inventive subject matter.

With respect to arrays of multiple planar magnetic transducers it should be appreciated that the particular geometry of the array will at least in part determine the acoustic performance of the microphone. For example, where the array has a convex or otherwise positively curved geometry (positive curvature may be horizontal and/or vertical), the captured range may include a wider angle. On the other hand, where multiple (e.g., 24 or more) transducers are employed in a flat array, the captured range may be relatively narrow (typically less than 10 degrees). One exemplary 6×4 flat array of planar magnetic transducers is depicted in FIG. 3.

Contemplated transducers and arrays may be employed in numerous manners, and all known manners are deemed suitable for use herein. However, it is especially preferred that the transducers and arrays may be employed in configurations and methods where high sensitivity and/or directionality is particularly desirable. For example, an observation system may include a plurality of arrays of planar magnetic transducers (e.g., above ground or submersible), wherein each of the arrays is configured to allow for directional acquisition of sound. Most preferably, but not necessarily, directional acquisition has cardioid or monopole characteristics. Such systems will further include a processing unit that is electronically coupled to at least two of the arrays and that is configured to determine one or more informational parameters of a sound emitting object.

Figure 4:
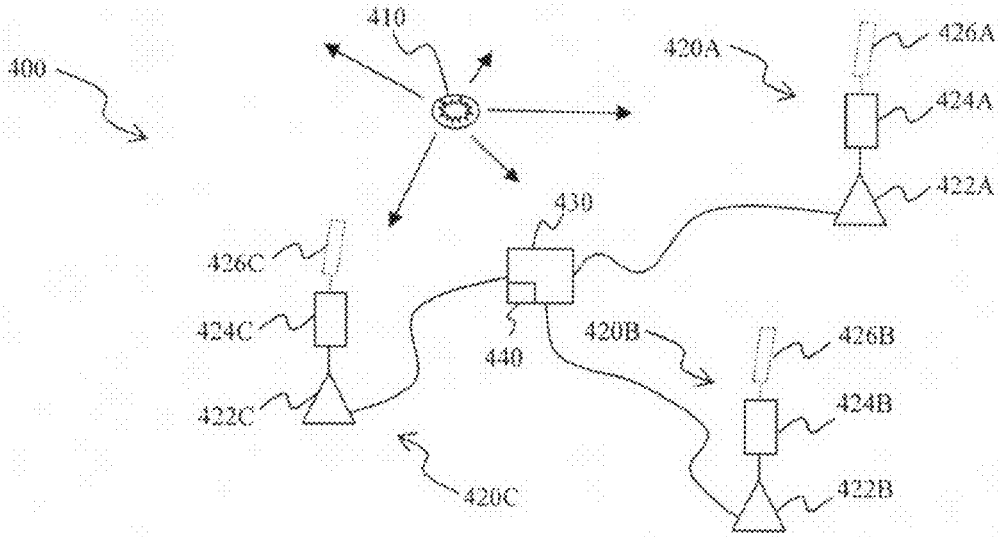
FIG. 4 is a schematic illustration of an exemplary observation system using contemplated planar microphones.

For example, FIG. 4 schematically illustrates an exemplary observation system 400 that has separate arrays 420A, 420B, and 420C. Each array is electronically coupled to the processing unit 430, which may further include an amplifier 440 that is electronically coupled to the plurality of arrays and that is configured to feed an electrical signal to at least one of the arrays to thereby operate at least one of the arrays as a speaker (the amplifier may also be integral with the array or be separate from the processing unit). Most preferably, each of the arrays includes a base unit 422A (422B, 422C) that allows at least temporarily stationary use of the array. Such base unit is most preferably configured to enable movement of the array about at least one spatial axis. Coupled to the base unit is then at least one array 424A (424B, 424C), that is most preferably operated as a microphone array with directional configuration (e.g., flat monopolar 6×4 array). An additional array 426A (426B, 426C) may be coupled to the same base unit and may be independently movable relative to the first array. Arrays may be configured for land use, submersed use, or air borne use.

The signals acquired by the arrays are then transmitted to the processing unit where the signals are then analyzed for the informational parameter. It should be appreciated that depending on the nature of the sound emitting object 410, the informational parameter may vary considerably. For example, where the sound emitting object is a moving object, the informational parameter may include distance of the object, speed of the object, number of objects, and/or size of the object(s). On the other hand, where the sound emitting object is a geological formation, the informational parameter may include distance of the object, chemical composition of the object, size of the object etc. In yet another example, the sound emitting object may be a sound source, and the informational parameter may include a communication signal (e.g., encoded or audio signal). Therefore, it should be recognized that the processing unit may be programmed to perform sound analysis, triangulation, echolocation, and/or seismography.

Moreover, it should be noted that the same microphone transducer can also be used as a speaker where current is delivered to the voice coil. In such scenario, the benefits of a strong magnetic field and tensioned diaphragm will directly translate to the ability to reproduce in an accurate manner sound in a full range (i.e., at least between 100 Hz to 20 kHz) at extremely high sound pressure levels (e.g., greater 140 db). Contemplated transducers, and especially arrays of contemplated transducers can be configured such that the transducer (s) can be operated as a directional speaker and/or as a very sensitive, directional, low distortion microphone. Most typically, the electronic circuitry for both uses is separately provided, but can also be provided in a combined operational unit. Thus, the function of the same transducer can be reversed, for example, at the flip of a switch or click of a mouse that effects feeding the transducer from an amplifier with an audio signal to produce sound or that effects routing a transducer signal to an amplifier to reproduce sound picked up by the transducer.

Consequently, it should be appreciated that contemplated transducers can be used as long distance "talkie-walkie" having accurate sound (re)production and sensitivity. Preliminary tests have shown that one can clearly transmit a message to a person hundreds of meters away using a transducer array as a powerful speaker, and with the flip of a switch, pick up the answer using the same array as a microphone. Similarly, where waterproof transducers are employed, it is contemplated that sound can be transmitted between submarines in a "walkie-talkie" style. Thus, by employing relatively large arrays, real time voice messages can be exchanged over distances of several miles. For example, an array on one submarine can be used as a speaker to transmit the voice message, while on the other submarine an array can be used as a sensitive, directional microphone to pick up the message. It should be recognized that not only voice communication can be transferred using contemplated systems, but also digital signals (e.g., to send or receive streaming data to allow underwater modem communication between submarines. In such case, the bit rate per second can be adjusted in such a way that transmitting signal lies within working frequency range of the array 100 Hz-20 KHz. The same principle can also be applied in the air.

Still further contemplated uses include search and rescue operations in which two or more transducers are employed as means of communication as well as a directional signal receiver for triangulation. For example, after a natural disaster or in war situations, people may be trapped within collapsed buildings. Using contemplated transducers, loud and clear messages can be sent with instructions to the trapped people to make noise or speak loudly. Then the transducer(s) are switched to microphone use in which low sound levels can be directionally picked up from the ruins. If at least two microphone arrays at some distance are used, triangulation or other geometrical methods can be employed in determining the location of the trapped individuals.

Figure 5:
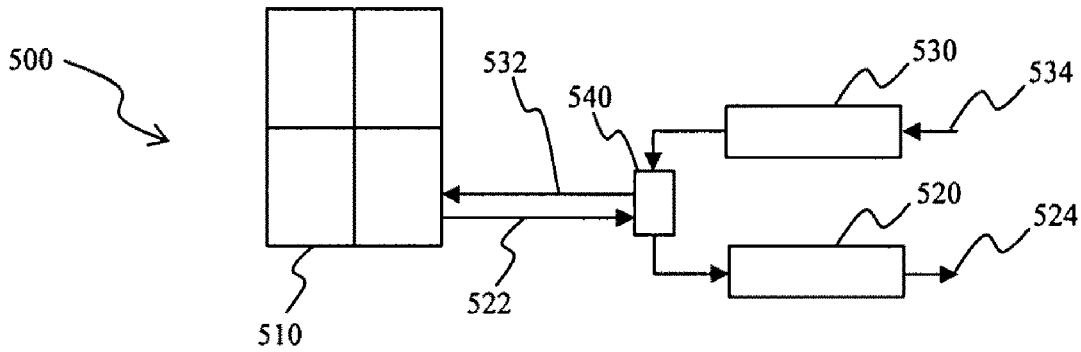
FIG. 5 is a schematic illustration of an exemplary communication system using contemplated planar microphones.

An exemplary configuration for such communication system is schematically illustrated in FIG. 5. Here, communication system 500 has an array 510 comprising four full-range planar magnetic transducers that are electronically coupled to a first amplifier 520 that is configured to amplify a first electrical signal from a voice coil of the transducer. A second amplifier 530 is electronically coupled to the full-range planar magnetic transducers and provides a second electrical signal to the voice coil of the transducer. Most typically, a switching device 540 will separate the inbound and outbound signals to an from the array 510. For example, audio signal 534 may be a line-level signal from a digital sound source (not shown) that is amplified by amplifier 530 to produce electrical current 532 sufficient to drive the diaphragms of the transducer array in speaker mode. In such mode, sound pressures of up to and above 130 db can be easily achieved. Once the sound message has been delivered, the switching device 540 is set to connect array 510 with amplifier 520. In this mode (microphone mode), sound picked up by the diaphragms of array 510 is converted to electrical current 522 (typically at line level) that is then routed to the amplifier 520 to produce detected sound signal 524, which may or may not be digitized. Of course, it should be recognized that the amplifiers 520 and 530 can be integrated into a single device, and that at least one of the amplifiers may be co-located with the array. Furthermore, all connections contemplated herein may be electrical connections, wireless connections, and/or optical connections.

Thus, specific embodiments and applications of full range planar magnetic microphones and arrays thereof have been disclosed. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

The invention claimed is:

1. A method of recording sound, comprising:

providing a planar magnetic transducer having a plurality of magnets and a tensioned diaphragm disposed between at least two of the magnets, wherein the diaphragm comprises a voice coil and wherein the magnets are arranged relative to each other such that:

(a) a distance between the at least two of the magnets is at least 1 mm, (b) an average magnetic flux density between the at least two magnets in a plane perpendicular to the diaphragm is at least 0.35 T and substantially homogenous, and (c) an average magnetic flux density between a third magnet and one of the at least two magnets in a plane of the diaphragm is at least 0.3 T;

wherein the diaphragm is sufficiently tensioned to allow recording of sound having a frequency of between 100 Hz and 20 kHz at a sound pressure level in a range of between 10 db and 140 db without compression and distortion;

exposing the transducer to a sound to thereby generate an electric signal in the voice coil; and feeding the electrical signal from the voice coil to an amplifier.

2. The method of claim 1 further comprising a step of feeding a second electrical signal to the transducer to thereby operate the transducer as a speaker when the transducer is not operated as a microphone.

3. The method of claim 2 wherein the second electrical signal causes the transducer to produce sound having a frequency of between 100 Hz and 20 kHz at a sound pressure level in a range of between 10 db and 100 db at 1 meter distance from the transducer.

4. The method of claim 1 further comprising a step of providing a second planar magnetic transducer and coupling the second transducer to the planar magnetic transducer to thereby form an array of transducers.

5. The method of claim 4 wherein the array of transducers comprises between two and thirty individual planar magnetic transducers.

6. The method of claim 4 wherein the array is configured to allow for directional acquisition of sound.

7. A method of recording sound, comprising:

providing a planar magnetic transducer having a plurality of magnets and a tensioned diaphragm disposed between at least two of the magnets, wherein the diaphragm comprises a voice coil and wherein the magnets are arranged relative to each other such that:

(a) a distance between the at least two of the magnets is at least 1 mm, (b) an average magnetic flux density between the at least two magnets in a plane perpendicular to the diaphragm is at least 0.35 T and substantially homogenous, and (c) an average magnetic flux density between a third magnet and one of the at least two magnets in a plane of the diaphragm is at least 0.3 T;

wherein the transducer has an upper portion and a lower portion, wherein the diaphragm is disposed between the upper portion and the lower portion, and wherein the upper and lower portions have a plurality of openings that are in fluid communication with water outside the transducer;

exposing the transducer to a sound to thereby generate an electric signal in the voice coil, wherein the transducer is submerged in water; and feeding the electrical signal from the voice coil to an amplifier.

8. The method of claim 7 wherein the diaphragm is sufficiently tensioned to allow recording of sound having a frequency of between 100 Hz and 20 kHz at a sound pressure level in a range of between 10 db and 100 db without compression and distortion.

9. The method of claim 7 wherein the diaphragm is sufficiently tensioned to allow recording of sound having a frequency of between 100 Hz and 20 kHz at a sound pressure level in a range of between 10 db and 140 db without compression and distortion.

10. The method of claim 7 wherein the diaphragm is coated with an electrically insulating layer to allow recording under water.

11. The method of claim 7 further comprising a step of providing a second planar magnetic transducer and coupling the second transducer to the planar magnetic transducer to thereby form an array of transducers.

12. The method of claim 7 wherein the array of transducers comprises between two and thirty individual planar magnetic transducers.

13. The method of claim 7 wherein the array is configured to allow for directional acquisition of sound.

14. A method of recording sound, comprising:

providing a planar magnetic transducer having a plurality of magnets and a tensioned diaphragm disposed between at least two of the magnets, wherein the diaphragm comprises a voice coil and wherein the magnets are arranged relative to each other such that:

(a) a distance between the at least two of the magnets is at least 1 mm, (b) an average magnetic flux density between the at least two magnets in a plane perpendicular to the diaphragm is at least 0.35 T and substantially homogenous, and (c) an average magnetic flux density between a third magnet and one of the at least two magnets in a plane of the diaphragm is at least 0.3 T;

providing a second planar magnetic transducer and coupling the second transducer to the planar magnetic transducer to thereby form an array of transducers, wherein the array has a substantially flat n1×n2 arrangement with an active transducer membrane area of between 50 $cm^2$ and 1000 $cm^2$;

wherein n1 and n2 are independently integers between 2 and 12, inclusive, and wherein n1/n2 is between 0.4 and 2.5, inclusive;

exposing the transducer to a sound to thereby generate an electric signal in the voice coil; and feeding the electrical signal from the voice coil to an amplifier.

15. The method of claim 14 wherein the diaphragm is sufficiently tensioned to allow recording of sound having a frequency of between 100 Hz and 20 kHz at a sound pressure level in a range of between 10 db and 100 db without compression and distortion.

16. The method of claim 14 wherein the diaphragm is sufficiently tensioned to allow recording of sound having a frequency of between 100 Hz and 20 kHz at a sound pressure level in a range of between 10 db and 140 db without compression and distortion.

17. The method of claim 14 wherein the diaphragm is coated with an electrically insulating layer to allow recording under water.

18. The method of claim 14 wherein the transducer has an upper portion and a lower portion, wherein the diaphragm is disposed between the upper portion and the lower portion, and wherein the upper and lower portions have a plurality of openings that are in fluid communication with water outside the transducer.

19. A method of recording sound, comprising:

providing a planar magnetic transducer having a plurality of magnets and a tensioned diaphragm disposed between at least two of the magnets, wherein the diaphragm comprises a voice coil and wherein the magnets are arranged relative to each other such that:

(a) a distance between the at least two of the magnets is at least 1 mm, (b) an average magnetic flux density between the at least two magnets in a plane perpendicular to the diaphragm is at least 0.35 T and substantially homogenous, and (c) an average magnetic flux density between a third magnet and one of the at least two magnets in a plane of the diaphragm is at least 0.3 T;

exposing the transducer to a sound to thereby generate an electric signal in the voice coil;

feeding the electrical signal from the voice coil to an amplifier;

feeding a second electrical signal to the transducer to thereby operate the transducer as a speaker when the transducer is not operated as a microphone; and wherein the second electrical signal causes the transducer to produce sound having a frequency of between 100 Hz and 20 kHz at a sound.

20. The method of claim 19 wherein the diaphragm is sufficiently tensioned to allow recording of sound having a frequency of between 100 Hz and 20 kHz at a sound pressure level in a range of between 10 db and 100 db without compression and distortion.

21. The method of claim 19 wherein the diaphragm is sufficiently tensioned to allow recording of sound having a frequency of between 100 Hz and 20 kHz at a sound pressure level in a range of between 10 db and 140 db without compression and distortion.

22. The method of claim 19 wherein the diaphragm is coated with an electrically insulating layer to allow recording under water.

23. The method of claim 19 further comprising a step of providing a second planar magnetic transducer and coupling the second transducer to the planar magnetic transducer to thereby form an array of transducers.

24. The method of claim 23 wherein the array of transducers comprises between two and thirty individual planar magnetic transducers.

25. The method of claim 23 wherein the array is configured to allow for directional acquisition of sound.

* * * * *